United States Patent [19]

Landskroener et al.

[11] 4,277,010

[45] Jul. 7, 1981

[54] VACUUM ROLLER FOR TRANSPORTING A WEB

[75] Inventors: Peter A. Landskroener, Bernardsville; John F. Dusenbery, Montclair; Roger W. Young, Upper Montclair, all of N.J.

[73] Assignee: John Dusenbery Company, Inc., Randolph, N.J.

[21] Appl. No.: 139,129

[22] Filed: Apr. 10, 1980

[51] Int. Cl.[3] ..... B65H 17/30

[52] U.S. Cl. ..... 226/95

[58] Field of Search ..... 226/95, 97; 242/74, 242/182

[56] References Cited

U.S. PATENT DOCUMENTS

| | | | |
|---|---|---|---|
| 2,753,181 | 7/1956 | Anander | 226/95 |
| 3,037,557 | 6/1962 | Faeber | 226/95 X |
| 3,630,424 | 12/1971 | Rau | 226/95 |
| 4,029,249 | 6/1977 | Nagel | 226/95 |
| 4,207,998 | 6/1980 | Schmid | 226/95 |

*Primary Examiner*—Edward J. McCarthy
*Attorney, Agent, or Firm*—Rudolph J. Jurick

[57] ABSTRACT

A drive roller and roller system for positive transport of a web, which system utilizes a vacuum for drawing the web against a selected portion of the roller, thereby to control the linear speed and the tension of the web.

8 Claims, 8 Drawing Figures

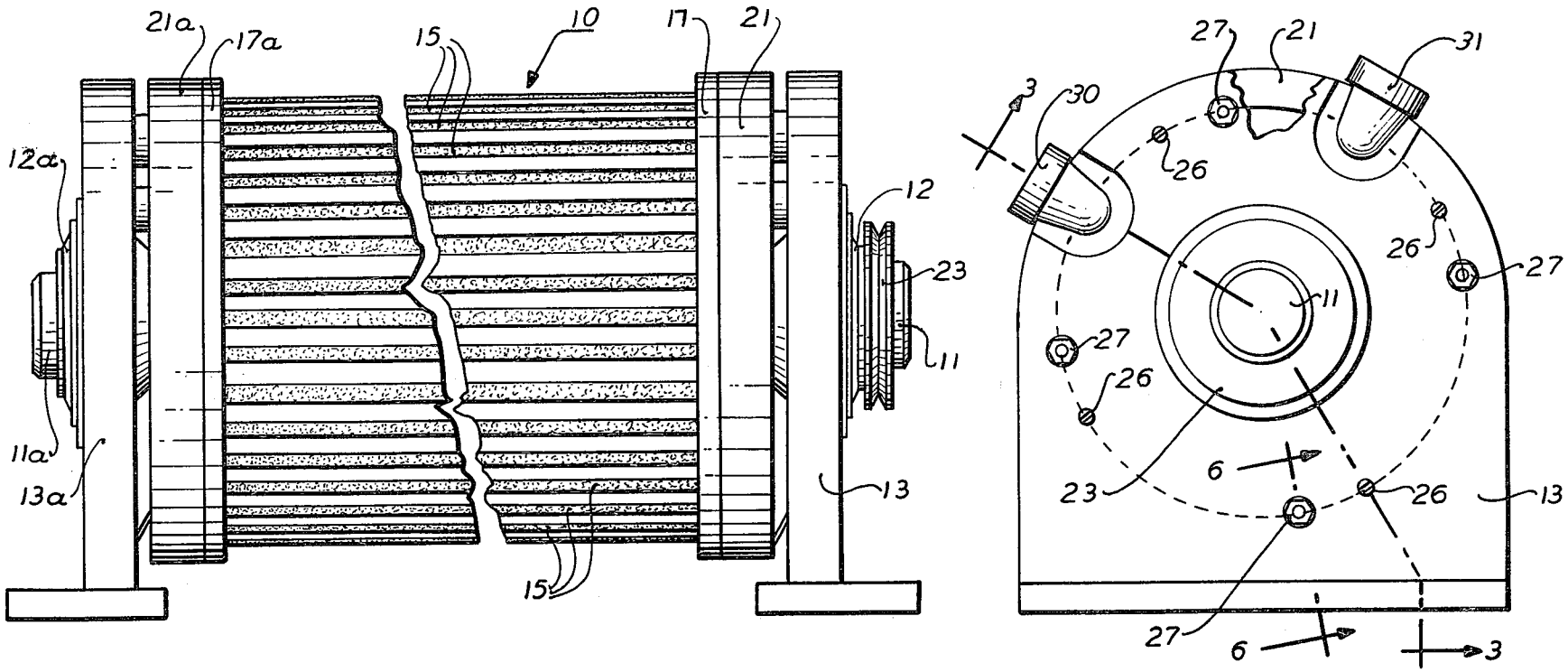
FIG. 1
FIG. 2
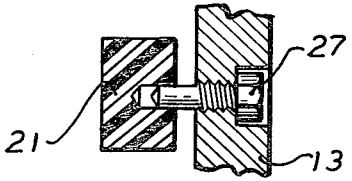
FIG. 6

VACUUM ROLLER FOR TRANSPORTING A WEB

BACKGROUND OF THE INVENTION

Various types of vacuum drive rollers are known in the art, the function of such rollers being to prevent slippage between a web and the roller, thus controlling the linear speed of the web.

U.S. Pat. No. 3,630,424, issued Dec. 28, 1971 to John A. Rau discloses a hollow drum connected to a vacuum line and having a pattern of holes formed in the peripheral surface thereof.

U.S. Pat. No. 4,029,249, issued June 14, 1977 to Peter Nagel et al discloses a hollow roller having a surface containing intersecting grooves with holes formed in the roller wall at the intersecting points of the grooves.

The above prior rollers have holes which extend through the roller wall and which are distributed over the entire peripheral surface of the roller. In operation, the web being transported by the roller overlies only a limited number of holes. Since a majority of the holes are open to the atmosphere, an exceptionally high vacuum must be maintained within the roller in order to effectively draw the web against the roller surface. This results not only in a loss of energy but, also, limits the total tension which can be applied to the web in order to prevent possible collapse of the roller. In other conventional rollers a deckling arrangement is used to selectively evacuate only a desired surface area of the roller. Inherent in such arrangements is a certain amount of leakage and, also, there is a limit to the vacuum which can be applied to prevent possible collapse of the roller. In any case, the holes in the prior rollers eventually become clogged by dirt and other foreign matter, requiring periodic removal of the roller for cleaning, with a consequent loss of machine operating time.

A vacuum roller made in accordance with this invention overcomes the shortcomings of prior such devices. It includes a plurality of air permeable members constructed and arranged so that the volume to be evacuated, per unit surface area of the roller, is minimal. Also, the area to be evacuated is immediately adjacent to the web. Thus, a higher vacuum can be utilized to apply a higher tension to the web without fear of the roller collapsing. Also, the roller is so constructed and arranged that the air permeable members are alternately connected to a vacuum line to draw the web against the roller surface, and to an air pressure line to blow out foreign matter from such members.

SUMMARY OF THE INVENTION

A hollow vacuum roller having a peripheral surface which includes a plurality of spaced, longitudinally-extending bars made of an air permeable material. The bars overlie channels formed in the roller outer surface, which channels extend to the ends of the roller for communication with either a vacuum line or an air line. Normally, a first predetermined number of the channels are in communication with the vacuum line while a second predetermined number of the channels are in communication wth the air line. Upon rotation of the roller channels first come into communication with the vacuum line, thereby to draw a web against the roller. Then these channels come into communication with the air line, thereby to release the web from the roller and blow out any foreign matter from the air permeable bars.

An object of this invention is the provision of an improved vacuum roller for transporting a web and applying a predetermined tension thereto.

An object of this invention is the provision of a vacuum roller having a peripheral surface which includes a plurality of spaced, longitudinally-extending bars made of an air permeable material, each bar overlying a channel formed in the outer surface of the roller, and means for connecting each channel sequentially to a vacuum line and an air line.

An object of this invention is the provision of a vacuum roller system in which the peripheral surface of the roller carries spaced bars of air permeable material, in which a first predetermined number of the bars are subjected to a pressure differential for the purpose of drawing a web against the roller surface, and in which a second predetermined number of the bars are subjected to a reverse pressure differential for the purpose of blowing foreign matter out of the bars.

The above-stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views:

FIG. 1 is a side elevational view of a roller system made in accordance with one embodiment of this invention;

FIG. 2 is a right end elevational view thereof;

FIG. 6 is a fragmentary, cross-sectional view taken along the line 6—6 of FIG. 2 and drawn to an enlarged scale;

DESCRIPTION OF PREFERRED EMBODIMENTS

Figure 4:
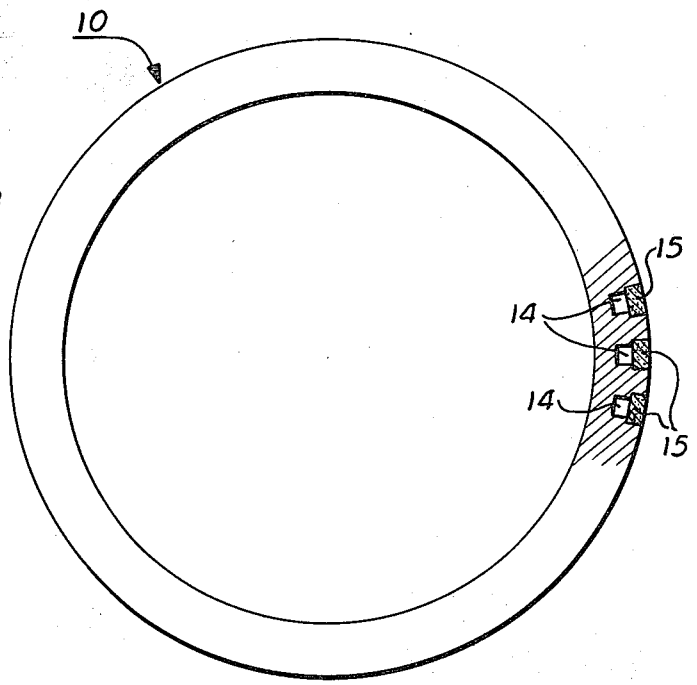
FIG. 4 is a fragmentary, cross-sectional view taken along the line 4—4 of FIG. 3.

Referring now to FIGS. 1-6, the roller comprises a cylinder 10, preferably made of stainless steel, secured to aligned shafts 11, 11*a* which are mounted for rotation in bearings 12, 12*a* carried by the mounting plates 13, 13*a*. Longitudinally-extending, spaced channels 14 are formed in the outer wall of the cylinder. These channels, which have stepped side walls, are spaced circumferentially over the entire peripheral surface of the cylinder. The channels are spanned by air permeable bars 15 which may, for example, be made of a sintered metal, and the outer surfaces of the bars have the same radius as the cylinder, thereby forming a smooth peripheral surface.

Figure 3:
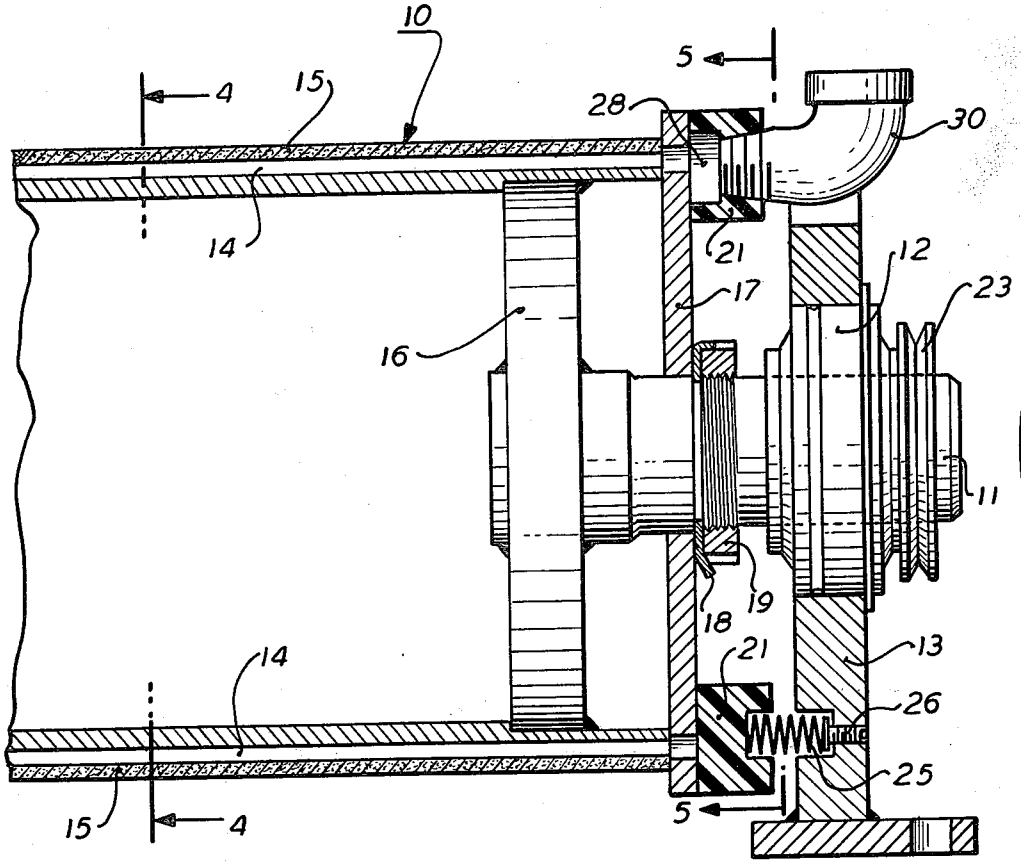
FIG. 3 is a fragmentary, cross-sectional view taken along the line 3—3 of FIG. 2 and drawn to an enlarged scale.

As shown in FIG. 3, the shaft 11 is welded to a plug ring 16 which ring is, in turn, welded to the inner wall of the cylinder 10. The central portion of the shaft is threaded and a hardened steel wear plate 17 is pressed into firm engagement with the end wall of the cylinder by means of a lockwasher 18 and a locknut 19. The central portion of the wear plate is of a reduced thickness and the marginal portion thereof is in face contact with the inner surface of a sealing ring 21. Circumferentially-spaced holes are formed in the marginal portion of the wear plate, which holes are aligned with the channels formed in the cylinder. The sealing ring may be made of a plastic having a low coefficient of friction. Alternatively, this ring may be made of metal and having a low coefficient of friction coating on the surface presented to the wear plate 17.

Referring now particularly to FIGS. 2 and 3, the sealing ring 21 is pressed into engagement with the wear plate by four coiled springs, one such spring 25 and the associated adjusting screw 26 being visible in the particular view of FIG. 3. All four of the adjusting screws are visible in the end view of FIG. 2. The sealing ring is prevented from rotation with the wear plate 17 by four lock bolts identified by the reference numeral 27 in FIG. 2. As shown in the fragmentary cross-sectional view of FIG. 6, the shank of the lock bolt 27 is threaded into a hole formed in the mounting plate 13 and the reduced-diameter end portion of the bolt fits snugly into a hole formed in the sealing ring 21.

Formed in the sealing ring are two arcuate bores which terminate at the surface which is in engagement with the wear plate. These bores are identified by the numerals 28 and 29 in FIG. 5 which is a cross-sectional view taken along the line 5—5 of FIG. 3. In the particular arrangement shown in FIG. 5, the bore 28 has an arcuate length such that it is in communication with six of the channels 14 formed in the cylinder 10. A conventional fitting 30, see also FIGS. 2 and 3, is secured to the sealing ring for connection of the bore 28 to a vacuum line, thereby to create a suction at the surfaces of the air permeable bars 15. It will be apparent that when the roller is in operation, a web passing around the roller will be drawn against the air permeable bars which occupy angular positions corresponding to the orientation of the bore 28. The other bore 29 communicates with the four of the channels 14 formed in the cylinder. A second fitting 31, see also FIG. 2, is secured to the sealing ring for connection to a source of air under pressure, thereby to provide a positive release of the web from the roller and, at the same time, to blow away any foreign matter which otherwise may accumulate on and/or in the air permeable bars.

It is here pointed out that the two ends of the roller are of similar construction. As the cylinder and wear plates are rotated, the longitudinal channels formed in the cylinder sweep, one after the other, into and out of communication with the bores formed in the sealing rings. The web first is drawn into engagement with each air permeable bar as such bar moves into alignment with the bores maintained at reduced air pressure. In the illustrated construction, there always are six bars against which the web is drawn at any instant, thereby preventing web slippage and providing positive control of the speed of the web. When the bars come into alignment with the bores in which an elevated air pressure is maintained two things occur. First, the web, should it still be in contact with the roller, is directed away from the roller surface and second, the bars are purged of foreign particles.

Figure 8:
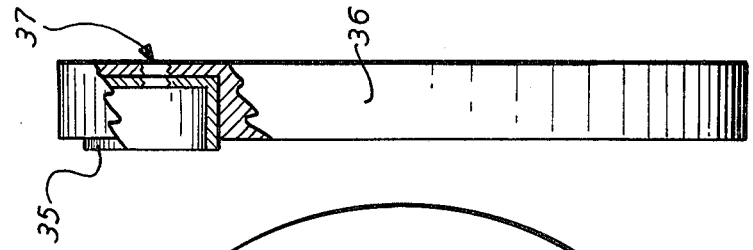
FIG. 8 is a corresponding side elevational view thereof with a portion of the sealing ring broken away.
Figure 7:
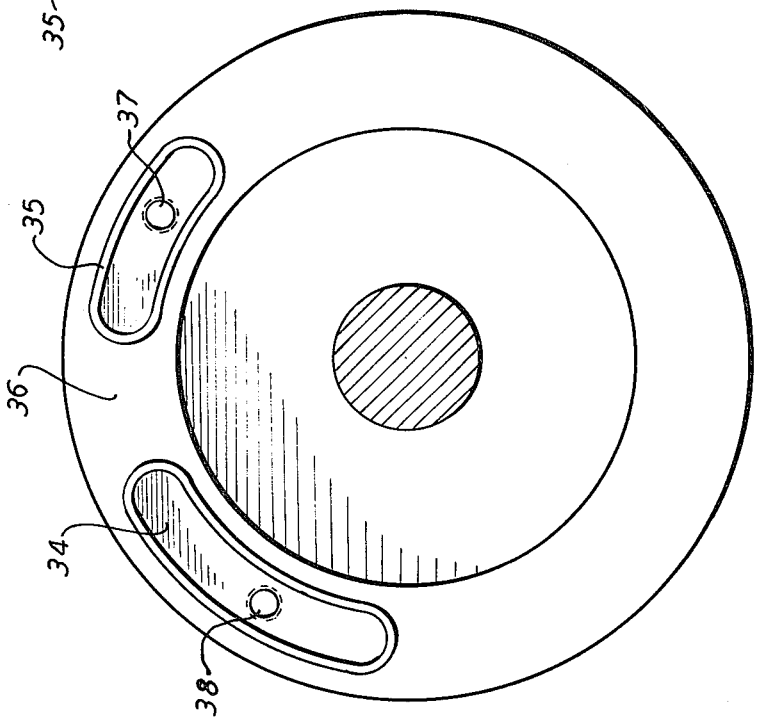
FIG. 7 is an end elevational view showing a sealing ring made in accordance with another embodiment of this invention.
Figure 5:
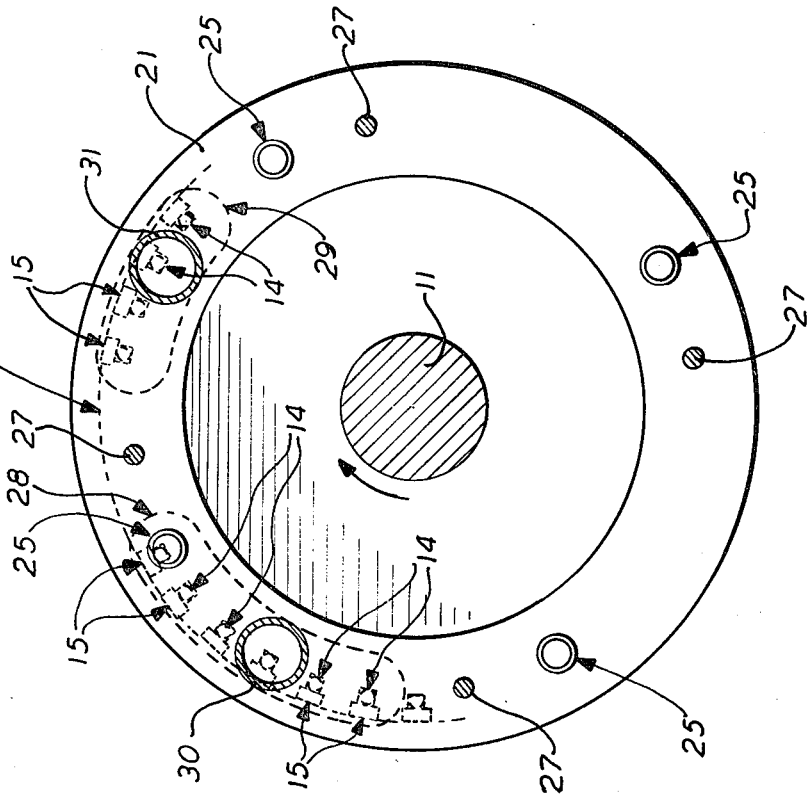
FIG. 5 is a cross-sectional view taken along the line 5—5 of FIG. 3.

FIGS. 7 and 8 show another embodiment of the invention. Here, arcuate inserts 34 and 35 are removably secured in correspondingly shaped bores formed in the sealing ring 36. These inserts have exposed surfaces for sliding engagement with the wear plates of the roller. Aligned, threaded holes 37 and 38 are formed in the sealing ring and the inserts for receiving the fittings for connection to the vacuum line and to the air pressure line. For general applications the inserts may be made of a plastic having a low coefficient of friction. However, this arrangement is of particular advantage where high pressure-velocity values are encountered as the inserts may be made of a metal having a low coefficient of friction.

A vacuum roller made as herein described has a long trouble free operating life and provides a positive grip on the web for positive transport of the web around the roller. By proper selection of the material of which the wear plate is made the roller can be operated at speeds substantially higher than prior devices of their type. Also, since the areas being evacuated are relatively small and located at the peripheral surface of the roller, a higher vacuum can be utilized to substantially increase the web tension without fear of collapsing the roller.

Having now described the invention what we desire to protect by Letters Patent is set forth in the following claims:

1. A roller for transporting a web by suction and comprising:

a. a cylindrical member mounted for axial rotation, b. a plurality of spaced longitudinally-extending channels formed in the peripheral surface of said cylindrical member, c. bars of air permeable material positioned in said channels, each bar having an inner surface spaced from the bottom wall of the associated channel and an arcuate outer surface lying on the outside diameter of said cylindrical member, and d. means for controlling the air pressure in selected channels.

2. The invention as recited in claim 1, wherein the said channels extend to the ends of said cylindrical member, and including wear plates closing the ends of the cylndrical member, said wear plates being mounted for rotation with the cylindrical member and including spaced holes aligned with the said channels.

3. The invention as recited in claim 2, wherein the cylindrical member is mounted for axial rotation by spaced shafts rotatable in bearings supported by mounting plates spaced from each end of the cylindrical member, and including a pair of sealing rings, means mounting each one of the sealing rings between one of the said mounting plates and the proximate wear plate, spring means pressing each sealing ring into face engagement with the associate wear plate, means securing the sealing rings against rotation relative to the mounting plates and means forming spaced, arcuate bores in each of the said sealing rings, each bore being in communication with a predetermined number of the holes formed in the associated wear ring.

4. The invention as recited in claim 3, wherein the said sealing rings are made of a material having a low coefficient of friction and the said bars are formed of sintered metal.

5. The invention as recited in claim 4, including means for connecting one arcuate bore of each sealing ring to a source of reduced air pressure, and means for connecting the other arcuate bore of each sealing ring to a source of elevated air pressure.

6. The invention as recited in claim 2, wherein the cylindrical member is mounted for rotation by spaced shafts rotatable in bearings carried by mounting plates spaced from each end of the cylindrical member, and including a pair of sealing rings, means mounting each one of the sealing rings between one of the said mounting plates and the proximate wear plate, means pressing each sealing ring into face contact with the associated wear plate, means securing the sealing rings against angular rotation relative to the mounting plates, means forming spaced arcuate bores in each of the said sealing rings, hollow cup-shaped inserts positioned in each of the said arcuate bores, each cup-shaped member having an open end portion projecting from the associated bore and in sliding engagement with the associated wear plate and the interior of each cup-shaped member communicating with a predetermined number of the holes formed in the associated wear ring.

7. The invention as recited in claim 6, wherein the said sealing rings and the said cup-shaped inserts are made of a material having a low coefficient of friction.

8. The invention as recited in claim 7, including means for connecting the interior of one cup-shaped insert of each sealing ring to a source of reduced air pressure, and means for connecting the interior of the other cup-shaped inserts of each sealing ring to a source of elevated air pressure.

* * * * *